US006768766B1

(12) United States Patent
Green

(10) Patent No.: US 6,768,766 B1
(45) Date of Patent: Jul. 27, 2004

(54) PRECAST ONE PIECE UPPER CASTABLE RING FOR INDUCTION FURNACES

(75) Inventor: Daniel K. Green, Clark, NJ (US)

(73) Assignee: ABB Inc., Norwalk, CT (US)

( * ) Notice: Subject to any disclaimer, the term of this patent is extended or adjusted under 35 U.S.C. 154(b) by 0 days.

(21) Appl. No.: 10/336,888

(22) Filed: Jan. 6, 2003

(51) Int. Cl.[7] ..... H05B 6/22

(52) U.S. Cl. ..... 373/156; 373/153

(58) Field of Search ..... 373/138, 151, 373/152, 153, 154, 155, 156, 158; 266/242, 275; 432/156

(56) References Cited

U.S. PATENT DOCUMENTS 3,944,715 A * 3/1976 Hegewaldt et al. ..... 373/153
4,622,679 A * 11/1986 Voss ..... 373/153
5,425,048 A * 6/1995 Heine et al. ..... 373/151

* cited by examiner

*Primary Examiner*—Tu Ba Hoang
(74) *Attorney, Agent, or Firm*—Michael M. Rickin

(57) ABSTRACT

An upper ring for an induction furnace. The upper ring is cast as one piece in a holder off of the furnace. The precast upper ring may be used as a replacement for the cast in place upper rings present on previously installed furnaces or may be used in the construction of new furnaces. The electromagnetic induction coil of the furnace may be modified to include cooling turns at its upper end when the holder with the one piece cast upper ring is installed on the furnace.

12 Claims, 3 Drawing Sheets

PRECAST ONE PIECE UPPER CASTABLE RING FOR INDUCTION FURNACES

FIELD OF THE INVENTION

This invention relates to induction furnaces and more particularly to the upper rings used in such furnaces.

DESCRIPTION OF THE PRIOR ART

An induction furnace employs electromagnetic energy to induce electrical currents to flow within a charge of metal or metal alloy. The electrical resistance of the metal produces heat as a natural consequence of the induced currents flowing in the metal. The combination of applied electrical power and frequency can be chosen to create sufficient heat within the metal to cause it to melt. The molten metal can then be poured into molds or otherwise used to produce a wide variety of metal products.

Referring now to FIG. 1 there is shown the cross-section of a traditional induction furnace 10. The basic elements of induction furnace 10 include an electromagnetic induction coil 12, a crucible or vessel 14 having a lining 28 of refractory material and a structure 16 for supporting the induction coil and vessel. The induction coil 12 comprises an electrical conductor of sufficient size and current capacity to produce the magnitude of magnetic flux necessary to induce large currents in the metal charge. The magnetic flux represents the lines of force of a magnetic field. The magnetic field emanates from the furnace coil and penetrates the charge material inside the crucible 14, causing induced current to flow in the charge resulting in the generation of heat culminating in the melting of the charge material.

Magnetic yokes 18 are placed at periodic intervals around the outside of the induction coil 12 and are pressed inward by means of clamping bolts 20 to hold the induction coil 12 in place. The yokes 18 provide radial support to the coil 12, the crucible 14, and the charge material contained therein. In addition, the yokes 18 prevent the stray flux surrounding the outside of the coil from entering the frame 16 of the furnace and causing unwanted heating of the structure. A further function of yokes 18 is to minimize exposure of operating personnel to stray magnetic fields in order to comply with applicable health and safety rules.

The coil 12 is held in place axially by means of concrete castings 22 and 24 in the form of a ring that are typically cast in place after the coil 12 and yokes 22 are installed. As is well known, lower ring 24 of traditional furnace 10 has straight outer walls. Also shown in FIG. 1 are the cover 25, the quick lining release push-out plug 26, Ground electrodes 27 and spout 29.

In some of the larger traditional furnaces there is axial compression on the coil 12 from the bottom only of those furnaces. Since in those furnaces the upper end of the coil 12 does not receive direct axial compression the longevity of the coil may be compromised under certain severe conditions of operation.

Although traditional furnace 10 has proven to be durable it may be necessary during the life of the furnace to change coil 12 or the cast in place upper ring 22 from time to time at an interval from 6 months to several years depending on severity of service. That change is a time consuming and lengthy procedure usually requiring at least several days and for larger furnaces up to two weeks. During that time period there is a loss of production from the furnace. Therefore it is desirable to reduce the amount of time and labor and thus the cost of replacing the coil or the upper ring and also allow a future replacement of either or both elements to be easily made. As can be appreciated a reduction in the amount of time to replace the coil or upper ring can add to production from the furnace. The structure and method of the present invention provides these benefits as well as benefits in the construction of new furnaces.

SUMMARY OF THE INVENTION

A method for replacing an upper ring casted on an induction furnace comprising replacing the upper ring casted on the furnace with a holder having a cured ring that is cast as one piece in the holder off of the furnace.

A method for replacing an upper ring casted on an induction furnace comprising:

a) casting an upper ring as one piece in a holder off of the furnace; and b) replacing the upper ring casted on the furnace with the holder having therein the one piece upper ring after the one piece upper ring is cured.

A method for replacing an upper ring of an induction furnace comprising:

a) removing the upper ring;

b) casting an upper ring as one piece in a holder off of the furnace; and c) placing the holder having the one piece upper ring therein on the furnace after the one piece upper ring is cured.

A method for replacing components in an induction furnace, the furnace comprising an upper ring, an induction coil, yokes, a lower ring and a frame, the method comprising:

a) removing the upper ring, the lower ring, the induction coil and the yokes from the furnace;

b) casting an upper ring as one piece in a holder off of the furnace;

c) returning the yokes to the furnace;

d) replacing the removed induction coil with an induction coil modified to include cooling turns at the top of the induction coil;

e) tightening the yokes while ensuring that the modified coil remains centered and plumb within the furnace frame;

f) casting a new lower ring on the furnace; and g) installing the holder on the furnace after the one piece upper ring is cured.

An induction furnace comprising:

a) a crucible having a refractory lining for holding a charge of metal or a metal alloy;

b) an electromagnetic induction coil surrounding the crucible; and c) upper and lower castable rings for holding the coil axially, the lower ring cast on the furnace and the upper ring in a holder and cast as one piece in the holder off of the furnace.

An upper ring for an induction furnace that comprises a holder in which the ring is cast in one piece, the holder for mounting the cast one piece upper ring on the furnace.

DESCRIPTION OF THE PREFERRED EMBODIMENT(S)

Figure 3:
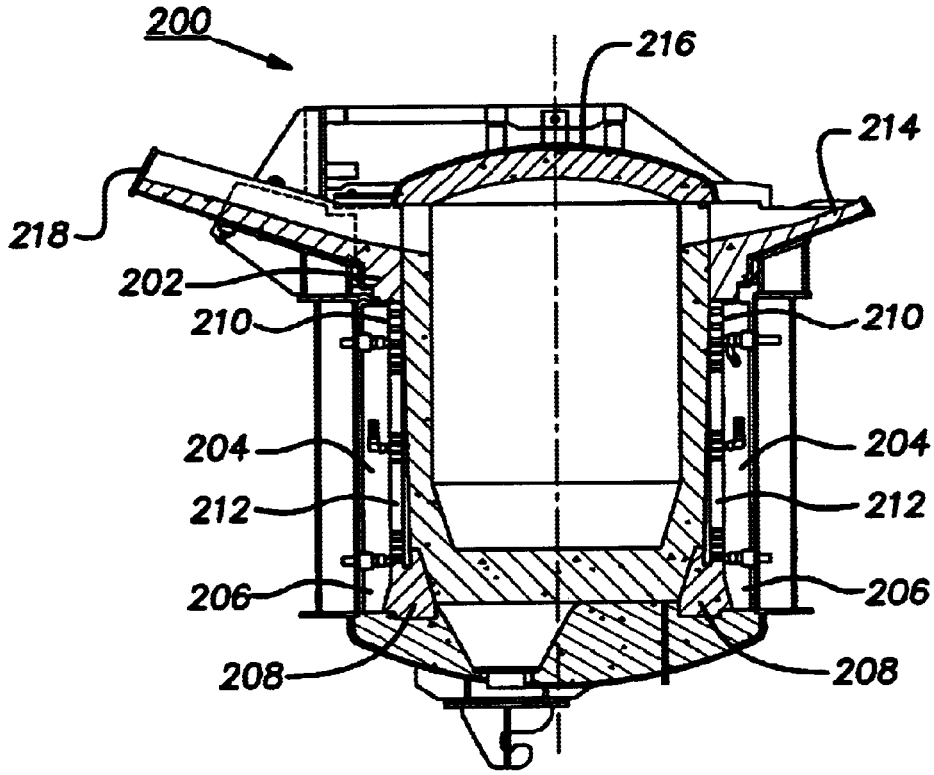
FIG. 3 shows a furnace with the precast upper head of the present invention therein and inverted yokes.
Figure 4:
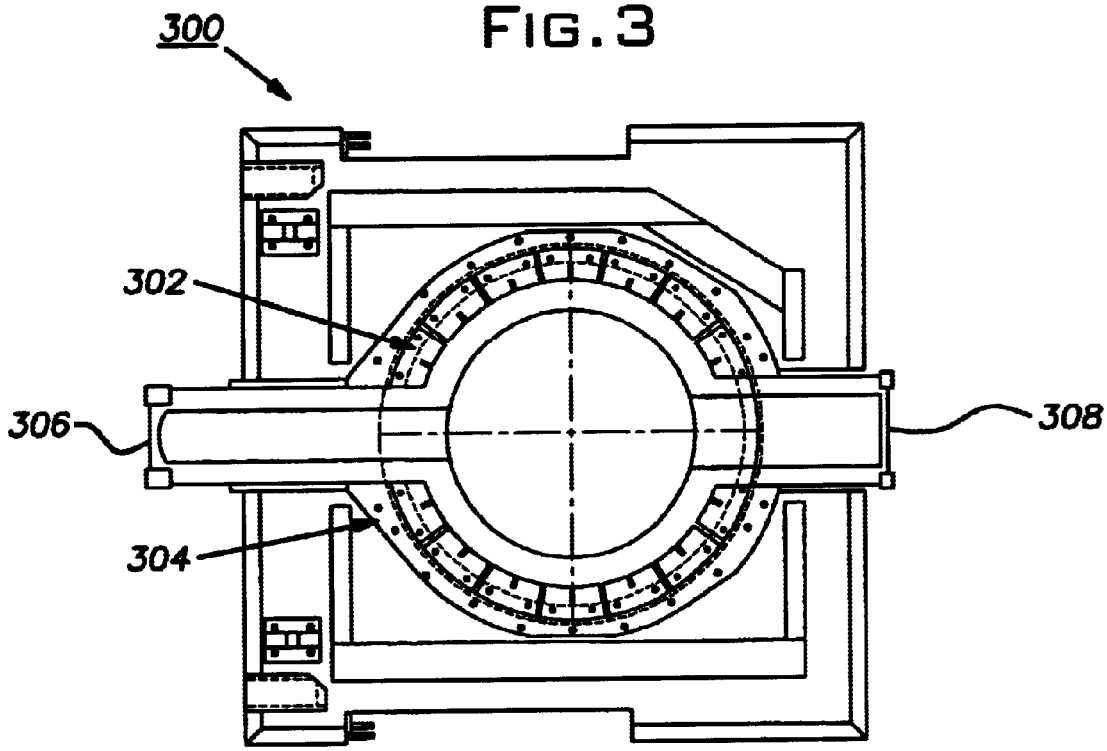
FIG. 4 shows a top view of a furnace with the precast upper head of the present invention therein.
Figure 5A:
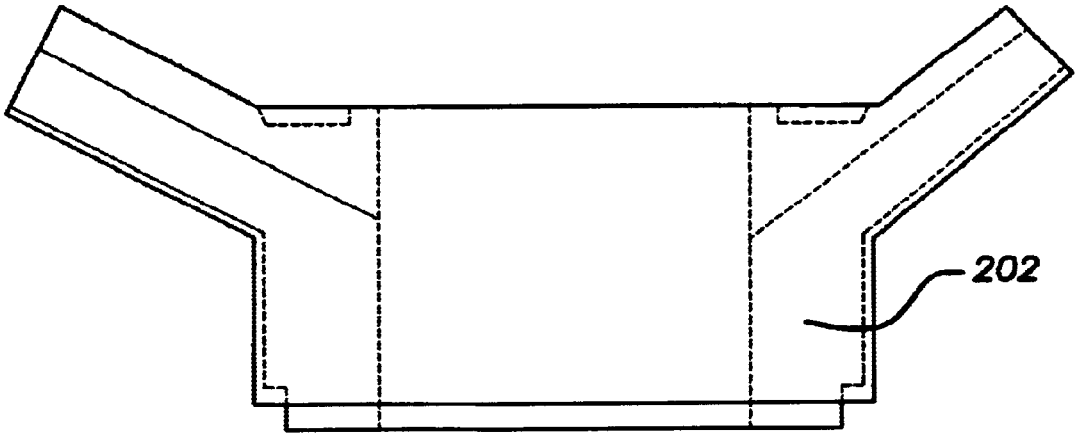
FIG. 5*a* shows the precast upper head of FIG. 3 without the rest of the furnace on which the head is mounted and FIG. 5*b* shows the precast upper ring shown in FIG. 4 prior to being bolted down to the furnace.
Figure 5B:
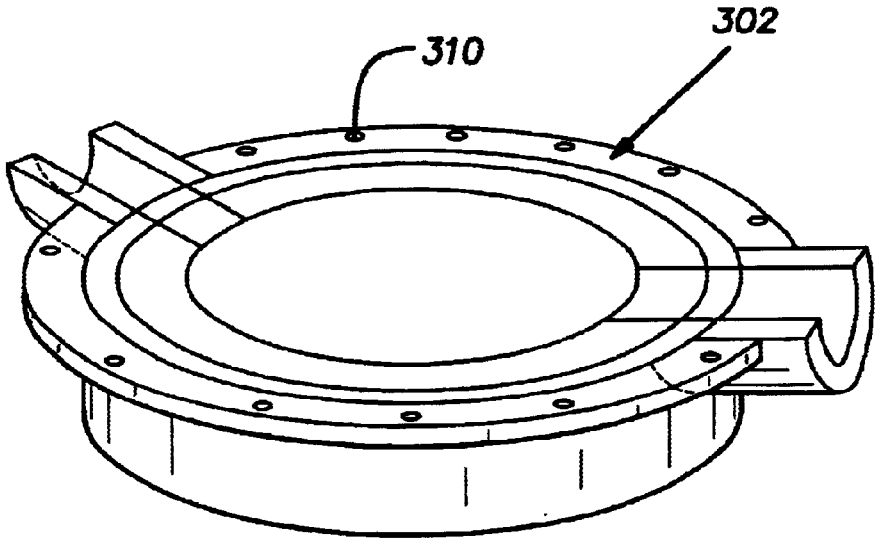

FIG. 5*a* shows the precast upper head 202 of FIG. 3 without the rest of the furnace that is shown in FIG. 3. FIG. 4 shows the precast upper ring 302 bolted down to the furnace 300. The precast upper ring 302 prior to being bolted down to the furnace 300 and thus the holder is shown in FIG. 5*b*. Holes 310 are for the bolts 304 shown in FIG. 4.

Figure 1:
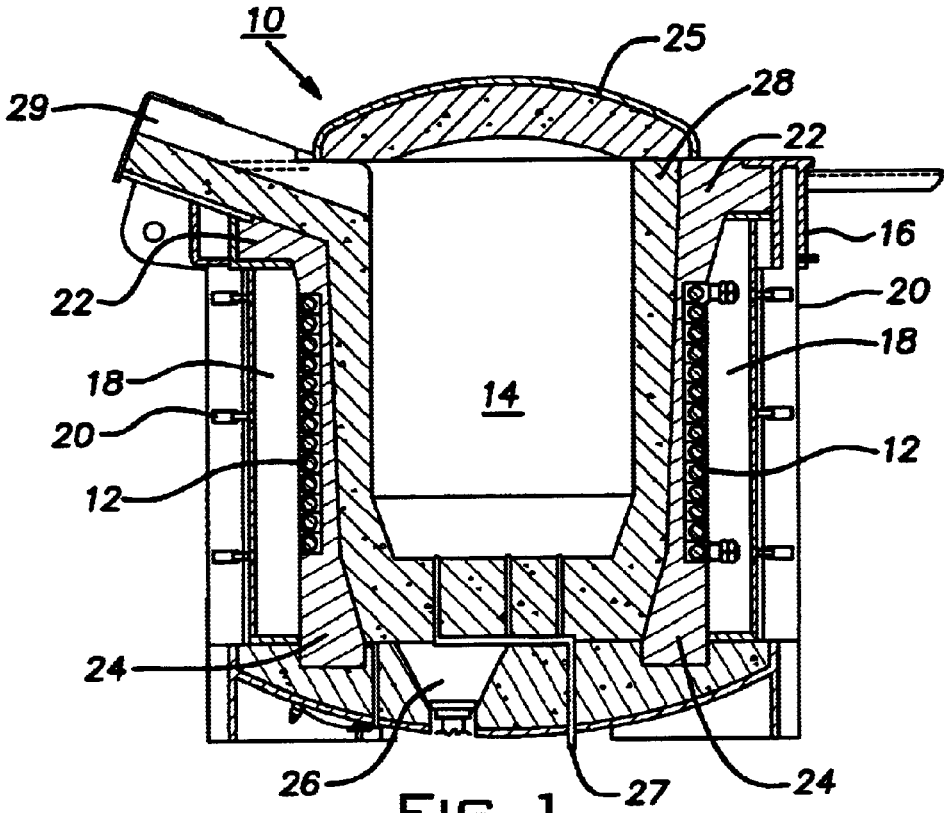
FIG. 1 PRIOR ART
FIG. 1 shows a cross section of a traditional induction furnace.
Figure 2:
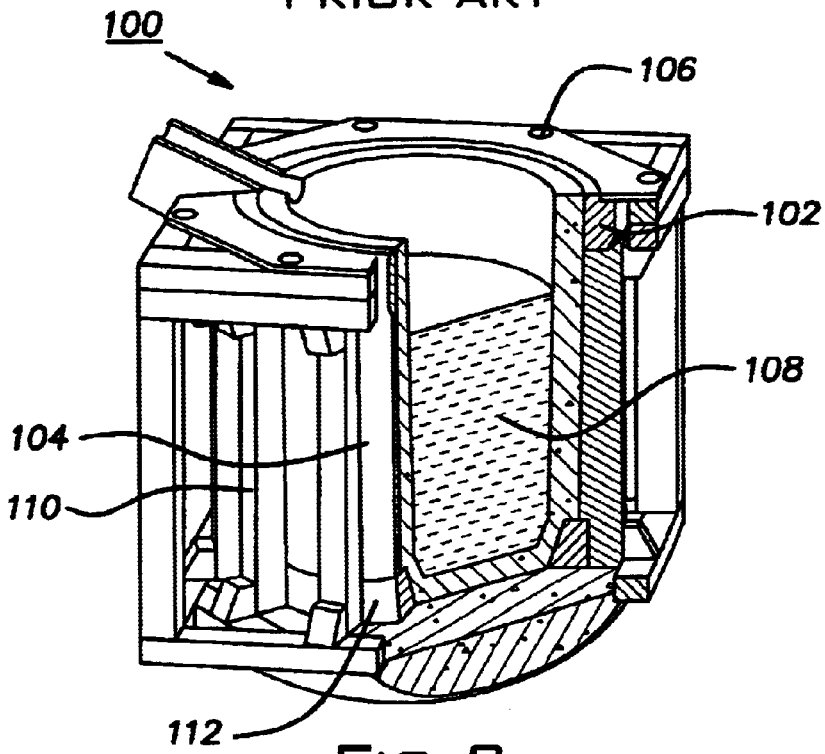
FIG. 2 shows a furnace with the precast upper head of the present invention therein.

Referring now to FIG. 2, there is shown a furnace 100 that has the precast upper head 102 of the present invention. The precast upper head 102 places the coil 104 under rigid axial compression, by virtue of head 102 being bolted down by bolts 106 to the top of the furnace body. A gap is provided between the bottom surface of the flange of head 102 and the top of the furnace body, ensuring that bolts 106 apply a downward axial force directly to the top of the furnace coil. This air gap is filled with refractory wool packing in order to prevent entry of dust and contamination into the area below the gap. This feature increases the strength and durability of the assembly, extending its operating life cycle.

FIG. 2 also shows molten bath 108, yokes 110 and lower castable ring 112.

In some traditional furnaces the magnetic yokes are tapered at the upper end. When those furnaces such as furnace 200 of FIG. 3 are retrofitted with the precast upper head 202 of the present invention, the yokes 204 are, as shown in FIG. 3, inverted, thereby placing the tapered end 206 at the bottom instead of the top. This inverted position allows the tapered area to accommodate a lower concrete ring 208 that has a pyramidal shape instead of the original straight outer wall, increasing the strength of this area substantially, resulting in a dramatically reduced tendency for cracking failure that is typically associated with such bottom concrete rings.

The precast upper head of the present invention allows the incorporation of integral upper cooling turns 210 into the upper end of the induction coil 212. The cooling turns 210 are profiled into a squared-off top end that provides a level surface against which the precast upper ring 202 can apply a uniform downward pressure to stabilize the complete assembly.

It is necessary to add the cooling turns 210 to the top of the coil if the one piece precast upper ring replaces the cast in place upper ring. The top cooling turn is profiled to provide a level surface against which the precast upper ring, when bolted down, can apply a uniform downward pressure on the top of the coil assembly around its entire circumference. Yet another benefit of the cooling turns 210 is that the upper part of the working refractory lining in the furnace is provided with more uniform cooling, minimizing thermal gradients in the area of the lining which is most affected by varying molten metal bath levels. This extends the working life of the refractory working lining and reduces the tendency to crack in this area due to thermal shock.

The one piece precast upper ring gives better coil support, which promotes longer coil life. This results from the head of the precast upper ring being bolted down to the top of the furnace body as is shown in FIG. 2 and also in FIG. 4. Due to the increased stability of the upper end of the coil, the coil life can be increased in larger furnaces compared to furnaces without the retrofit. The increased coil life results from better clamping of the coil turns and the high temperature insulation that separates them, preventing the segments from becoming dislodged due to vibration. The high temperature insulation, which is present on both the original and modified furnaces, is a fiberglass reinforced epoxy laminate sheet cut into arc shaped segments that are inserted between the turns of the induction coil. The purpose of the sheets is to provide electrical turn to turn insulation.

The present invention preserves all of the remaining original features and advantages of the "open cage" design, including easy access to the coil and all connections, and ease of repair with the coil in place. The open cage design, which was originated by a company associated with the assignee of the present invention and is now used by most other manufacturers of induction furnaces, is a furnace with a frame that is not enclosed or shrouded by a steel shell. The advantages of the open cage design relate mainly to ease of access and better maintainability.

FIG. 3 also shows furnace 200 with a back-slagging spout 214 that is associated with a backtilt feature and an exhaust hood 216. Although these features are not a part of the present invention, they may be added to the furnace in combination with the precast upper head retrofit and are described briefly here. The exhaust hood 216 enables the efficient removal of fumes and smoke generated during the melting operations. The backtilt feature enables the entire body of the furnace 200 to be tilted backward, enabling the slag generated during melting to be raked off the back-slagging spout 214, making this operation easier to accomplish. Also shown in FIG. 3 is pouring spout 218.

In FIG. 4, a top view of a furnace 300 without an exhaust hood is shown with the precast upper ring 302 of the present invention installed. In this view the upper ring hold-down bolts 304 are clearly shown. The ring 302 is installed with clearance between the underside of its flange surface and the top deck of the furnace. Thus, when the bolts 304 are tightened, the upper end of the induction coil assembly is placed under rigid axial compression, making the coil assembly more stable and rigid in operation leading to longer life of the coil assembly and the refractory lining that it supports. Also shown in FIG. 4 are pouring spout 306, back-slagging spout 308.

The steps associated with retrofitting the one piece precast upper ring of the present invention to an existing traditional furnace are now described. The first operation is the removal of the existing cast in place upper ring. After this ring is removed, the bottom cast in place ring is removed by jackhammering or similar methods. A coil-lifting fixture is then lowered into place, and the coil is securely clamped into the fixture. The yokes are first strapped to the furnace frame with suitable cables or straps to stabilize them, then loosened enough to free the coil by means of backing off the yoke bolts. The coil is then lifted out of the furnace.

Typically a spare coil will be sent out for modification in advance of the teardown process so that there is a modified coil on site ready to be installed. Typically the coil that is removed during teardown will be sent out to a coil refurbishing facility for modification involving the addition of cooling turns. This modified coil will then become the new spare, which will be utilized on the next coil change, which could occur up to several years later.

The next operation is to remove the yokes from the furnace. These are placed on the floor face down, ready for modification involving installation of new pressure plates. The pressure plates are arc-shaped steel bars that are typically placed at four locations on the back side of each magnetic yoke. Their purpose is to provide a mechanically stable contact point for receiving the pressure applied by means of the yoke bolts. When the yoke is inverted, the pressure points are at different positions compared to their original positions requiring new plates to be provided. Usually there is one pressure point near each end, and one or two closer to the middle.

The new parts that are needed for the retrofit such as the new pressure plates can be supplied as a part of a kit that includes the following:

1. Precast upper ring assembly, comprising the new furnace head, preferably with a spare head for quick exchange;
2. Forms for casting the one piece upper ring;
3. Yoke pressure plates;
4. Hold down bolts for the upper ring; and
5. Coil modification package, providing the upper cooling turns.

The reassembly of the furnace proceeds as follows. The modified yokes are placed in the furnace in the new inverted position, tapered end down, and their top ends are strapped or cabled in place to stabilize them. Next a modified coil, with new cooling turns added, is lowered into place. The yokes are then carefully pre-tightened while ensuring that the coil remains centered and plumb within the frame of the furnace, followed by a final tightening.

This is followed by the casting of the lower ring, which is cast in place, as was previously the case with the original furnace. Casting the lower ring in place does not comprise a serious operational delay because it can be safely and quickly dried or cured in place without risk of damage to the coil. This is so principally because the moisture released from the lower ring during dryout and curing runs away from the induction coil and not toward it.

The one piece precast top ring can be cast and cured or dried at any time before the furnace is being torn down. The one piece precast top ring of the present invention is typically used when replacement of the coil is required. The cast in place upper ring must always be replaced during a coil change and therefore it is natural to install the one piece precast top ring when a coil change is required either due to accidental damage or due to a scheduled periodic replacement.

It is to be understood that while the present invention is described herein as a retrofit for existing traditional furnaces, it can also be applied to new furnaces by anyone of ordinary skill in the art of induction furnaces. Therefore, the application of the present invention to new induction furnace construction should be construed as an integral part of the present invention along with its application as a retrofit to existing induction furnaces.

It is also to be understood that the description of the preferred embodiment(s) is (are) intended to be only illustrative, rather than exhaustive, of the present invention. Those of ordinary skill will be able to make certain additions, deletions, and/or modifications to the embodiment (s) of the disclosed subject matter without departing from the spirit of the invention or its scope, as defined by the appended claims.

What is claimed is:

1. A method for replacing an upper ring casted on an induction furnace comprising:

replacing said upper ring casted on said furnace with a holder having a cured ring that is cast as one piece in said holder off of said furnace.

2. A method for replacing an upper ring casted on an induction furnace comprising:

a) casting an upper ring as one piece in a holder off of said furnace; and b) replacing said upper ring casted on said furnace with said holder having therein said one piece upper ring after said one piece upper ring is cured.

3. A method for replacing an upper ring of an induction furnace comprising:

a) removing said upper ring;

b) casting an upper ring as one piece in a holder off of said furnace; and c) placing said holder having the one piece upper ring therein on said furnace after said one piece upper ring is cured.

4. A method for replacing components in an induction furnace, said furnace comprising an upper ring, an induction coil, yokes, a lower ring and a frame, said method comprising:

a) removing said upper ring, said lower ring, said induction coil and said yokes from said furnace;

b) casting an upper ring as one piece in a holder off of said furnace;

c) returning said yokes to said furnace;

d) replacing said removed induction coil with an induction coil modified to include cooling turns at the top of said induction coil;

e) tightening said yokes while ensuring that said modified coil remains centered and plumb within said furnace frame;

f) casting a new lower ring on said furnace; and g) installing said holder on said furnace after said one piece upper ring is cured.

5. The method of claim 4 further comprising holding said holder tight to the top of said frame.

6. The method of claim 4 wherein said yokes have a tapered end and a non-tapered end and pressure plates are added to said non-tapered end and said yokes with said added pressure plates are installed when returned to said furnace with said tapered end facing said furnace lower ring.

7. An induction furnace comprising:

a) a crucible having a refractory lining for holding a charge of metal or a metal alloy;

b) an electromagnetic induction coil surrounding said crucible; and c) upper and lower castable rings for holding said coil axially, said lower ring cast on said furnace and said upper ring in a holder and cast as one piece in said holder off of said furnace.

8. The induction furnace of claim 7 further comprising a frame and bolts for holding said holder tight against the top of said frame.

9. The induction furnace of claim 7 further comprising magnetic yokes placed at periodic intervals around the outside of said induction coil.

10. The induction furnace of claim 9 further comprising bolts to press said yokes inwardly towards said induction coil to thereby hold said coil in place.

11. The induction furnace of claim 7 further comprising cooling turns at the top of said induction coil.

12. An upper ring for an induction furnace comprising a holder in which said upper ring is cast in one piece, said holder for mounting said cast one piece upper ring on said furnace.

* * * * *